US006074437A

United States Patent [19]

Racherla et al.

[11] Patent Number: 6,074,437

[45] Date of Patent: Jun. 13, 2000

[54] BLEACHING WITH POLYOXOMETALATES AND AIR OR MOLECULAR OXYGEN

[75] Inventors: Uday Shanker Racherla, West Caldwell, N.J.; Qin Chen, Westerville, Ohio

[73] Assignee: Unilever Home & Personal Care USA, Division of Conopco, Inc., Greenwich, Conn.

[21] Appl. No.: 09/264,191

[22] Filed: Mar. 5, 1999

Related U.S. Application Data

[60] Provisional application No. 60/113,606, Dec. 23, 1998.

[51] Int. Cl.[7] ..... D06L 3/02

[52] U.S. Cl. ..... 8/111; 510/302; 510/367; 252/184.43

[58] Field of Search ..... 8/111; 510/302, 510/367; 252/184.43

[56] References Cited

U.S. PATENT DOCUMENTS

| | | | |
|---|---|---|---|
| 5,114,691 | 5/1992 | Pinnavaia et al. | 423/244.02 |
| 5,178,989 | 1/1993 | Heller et al. | 430/323 |
| 5,302,248 | 4/1994 | Weinstock et al. | 162/79 |
| 5,334,780 | 8/1994 | Shaikh et al. . | |
| 5,549,789 | 8/1996 | Atalla et al. . | |
| 5,552,019 | 9/1996 | Weinstock et al. . | |
| 5,557,014 | 9/1996 | Grate et al. . | |
| 5,695,605 | 12/1997 | Weinstock et al. | 162/79 |
| 5,695,606 | 12/1997 | Weinstock et al. | 162/79 |
| 5,824,189 | 10/1998 | Weinstock et al. | 706/16 |

FOREIGN PATENT DOCUMENTS

| | | |
|---|---|---|
| 2183814 | 8/1996 | Canada . |
| 0 466 471 | 1/1992 | European Pat. Off. . |
| 0 572 036 | 12/1993 | European Pat. Off. . |
| 0 771 781 | 5/1997 | European Pat. Off. . |
| 19530786 | of 0000 | Germany . |
| 44 24 625 | 7/1994 | Germany . |
| 07010797 | of 0000 | Japan . |
| 07149685 | of 0000 | Japan . |
| 94/05849 | 3/1994 | WIPO . |
| 95/26438 | 10/1995 | WIPO . |
| 97/36680 | 10/1997 | WIPO . |
| 98/20101 | 5/1998 | WIPO . |
| 99/28426 | 6/1999 | WIPO . |

*Primary Examiner*—Yogendra Gupta
*Assistant Examiner*—Christine Ingersoll
*Attorney, Agent, or Firm*—Milton L. Honig

[57] ABSTRACT

A method for bleaching laundry and household surfaces is provided which includes preparing a wash medium with a bleaching composition incorporating polyoxometalates and being free of any effective amount of a bleaching agent such as hydrogen peroxide, organic peracids, inorganic peracids, organic persalts, inorganic persalts, Caro's acid, Caroates and mixtures thereof. A second step involves contacting a stained substrate such as a fabric, kitchenware or a household hard surface for a time and in an amount sufficient to remove the stains. Air is employed as a primary source of oxygen atoms for bleaching.

5 Claims, No Drawings

BLEACHING WITH POLYOXOMETALATES AND AIR OR MOLECULAR OXYGEN

This application claims the benefit of U.S. Provisional Application No. 60/113,606, filed Dec. 23, 1998.

BACKGROUND OF THE INVENTION

1. Field of the Invention

The invention concerns methods for bleaching fabrics and household hard surfaces with peroxides sourced directly from air.

2. The Related Art

Oxygen bleaches are well known for their ability to remove stains from substrates. Traditionally the substrate, such as a fabric, is subjected to hydrogen peroxide or substances which can generate hydroperoxyl radicals. The latter may be inorganic or organic peroxides. Generally these systems must be activated. Temperatures of 60° C. and higher are effective to accomplish the activation. Unfortunately, high temperatures lead to inefficient cleaning. High temperatures can also cause damage to the substrates.

A preferred approach to generating hydroperoxyl bleach radicals is the use of an inorganic peroxide coupled with an organic precursor compound. These systems are employed for many commercial laundry powders. European systems are based on tetraacetyl ethylene diamine (TAED) in combination with sodium perborate or percarbonate. Well known in the United States is a laundry bleach product based on the precursor sodium nanoyloxybenzenesulphonate (SNOBS) coupled with sodium perborate. Precursor systems are effective yet they also exhibit several disadvantages. Precursors are moderately sophisticated organic molecules requiring multi-step manufacturing processes resulting in high capital costs. Secondly, precursor systems have large formulation space requirements; a significant percent of a laundry powder must be devoted to the bleach components leaving less room for other actives and complicating development of concentrated powders. Further, precursor systems do not bleach very efficiently in countries where consumers have wash habits entailing low dosage, short wash times, cold temperatures and low wash liquor to cloth ratios.

A long cherished dream has been to use air directly as the oxygen source. Air would avoid costly synthesized organic precursors and persalts.

Canadian Patent 2,183,814 (Reinhardt et al.) reports use of Polyoxometalates as bleaching catalysts for removal of stain from fabrics. The process requires an active-oxygen agent which may be hydrogen peroxide, organic peracids, inorganic peracids, organic persalts or inorganic persalts. Molecular oxygen or air are neither indicated nor suggested as the oxidation source.

WO 98/20101 (Mishra et al.) reports use of tungsten salts for catalyzing bleaching by hydrogen peroxide, percarbonates, perborates, various hydrogen peroxide adducts and mixtures thereof. Likewise, this disclosure requires that the source of oxygen be a liquid or a solid peroxy chemical. This patent is focused upon the removal of stains from various hard surfaces and textiles.

Accordingly, it is an object of the present invention to provide a bleaching system with stain removal efficacy based on molecular oxygen.

Another object of the present invention is to provide a bleaching system which is cost-effective and environmentally friendly.

Still another object of the present invention is to provide a bleaching system based on molecular oxygen operable at relatively low temperatures, short contact times and low dosage requirements.

These and other objects of the present invention will become more readily apparent from the following summary and detailed description.

SUMMARY OF THE INVENTION

A method for bleaching laundry or household surfaces is provided which includes:

(i) providing a wash medium with a bleaching composition comprising polyoxometalates; and (ii) contacting a stained substrate for a time and in an amount sufficient to remove the stains; and wherein air is employed as a primary source of oxygen atoms for bleaching.

DETAILED DESCRIPTION OF THE INVENTION

Now it has been discovered that stains can be removed simply by air oxidation through the catalysis of Polyoxometalates. Expensive oxygen bleaching agents such as hydrogen peroxide, organic peracids, inorganic peracids, organic persalts, inorganic persalts, Caro's acid, Caroates and bleach precursors are found to be unnecessary.

A polyoxometalate is an essential feature of the present invention. Polyoxometalates are inorganic complexes which are transition metal-oxygen-anion clusters. They have defined oligomeric or polymeric structural units which form spontaneously under appropriate conditions in an aqueous medium from simple compounds of vanadium, niobium, tantalum, molybdenum or tungsten. The polyoxometalates are subdivided into isopoly- and heteropolyoxometalates. (see M. T. Pope. Heteropoly and Isopoly Oxometalates, Springer-Verlag, Berlin, 1983).

Isopolyoxometalates are the simpler of the forms. They can be described as binary, i.e. containing only metal ion and oxygen, oxide anions of the formula $[M_mO_y]^{p-}$. Typical examples are $[Mo_2O_7]^{2-}$, $[WO_7O_{24}]^{6-}$, $[Mo_6O_{19}]^{2-}$ and $[Mo_{36}O_{112}]^{8-}$.

In contrast, heteropolyoxometalates also contain further non-metal, semi-metal and/or transition metal ions. Heteropolyoxometalates of the general form $[X_xA_aM_mO_y]^{p-}$, where X is a nonmetal or semi-metal ion and A is a transition metal ion, possess one or more so-called heteroatoms X and/or A. One example is $[PW_{12}O_{40}]^{3-}$ (where X=P). By substitution of $M_mO_y$ structural units in both isopoly- and heteropolyoxometalates for a transition metal ion A it is possible to introduce redoxidative transition metal ions of type A into the solid structures. Known examples include transition metal-doped, so-called Keggin anions of the formula $[APW_{11}O_{39}]^{7-/8-}$ where A=Zn, Co, Ni, Mn (J. Amer. Chem. Soc., 113, page 7209, 1991) and Dawson anions $[AP_2W_{17}O_{61}]^{7-/8-}$ where A=Mn, Fe, Co, Ni, Cu (J. Amer. Chem. Soc. 109, page 402, 1987), which may also contain bound water of crystallization. Further substitutions, including different transition metal ions, are known, for example $[WZnMn_2(ZnW_9O_{34})_2]^{12-}$ (J. Amer. Chem. Soc. 116, page 5509, 1994). The charge of the above-described anions are compensated by protons (thereby giving the corresponding poly acids) or by cations (formation of poly-acid salts= heteropolyoxometalates).

For simplicity, the term polyoxometallate as used in the description embraces not only the salts of the polyacids but also the corresponding poly acids themselves.

The bleaching catalysts used in accordance with the invention preferably have the formula (1)

$$(Q)_q(A_aX_xM_mO_yZ_z(H_2O)_b)cH_2O \quad (1)$$

where Q, A, X, M, Z, q, a, x, m, y, z, b and c are defined as follows:

Q is one or more cations selected from the group consisting of H, Li, K, Na, Rb, Cs, Ca, Mg, Sr, Ba, Al, $PR^1R^2R^3R^4$ and $NR^1R^2R^3R^4$, in which $R^1$, $R^2$, $R^3$ and $R^4$ are identical or different and are H, $C_1$–$C_{20}$-alkyl, $C_5$–$C_8$-cycloalkyl or $C_6$–$C_{24}$-aryl;

q is a number from 1 to 60, in particular from 1 to 40, and for monovalent countercations simultaneously describes the charge of the anionic unit;

A is one or more transition metals from subgroups 2 to 8, preferably Mn, Ru, V, Ti, Zr, Cr, Fe, Co, Zn, Ni, Re and Os, particularly preferably Mn, Ru, V, Ti, Fe, Co and Zn;

a is a number from 0 to 10, preferably from 0 to 8;

X is one or more atoms selected from the group consisting of Sb, S, Se, Te, Bi, Ga, B, P, Si, Ge, F, Cl, Br and I, preferably P, B, S, Sb, Bi, Si, F, Cl, Br and I;

x is a number from 0 to 10, preferably 0 to 8;

M is one or more transition metals selected from the group consisting of Mo, W, Nb, Ta and V;

m is a number from 0.5 to 60, preferably 4 to 10;

Z is one or more anions selected from the group consisting of $OH^-$, $F^-$, $Cl^-$, $Br^-$, $I^-$, $N_3^-$, $NO_3^-$, $ClO_4^-$, $NCS^-$, $SCN^-$, $PF_6^-$, $RSO_3^-$, $RSO_4^-$, $CF_3SO_3^-$, $BR_4^-$, $BF_4^-$, $CH_3COO^-$ where R is H, $C_1$–$C_{20}$-alkyl, $C_5$–$C_8$-cycloalkyl or $C_6$–$C_{24}$-aryl;

z is a number from 0 to 10, preferably from 0 to 8;

O is oxygen;

y is the number of oxygen atoms required for structure/charge compensation, and b and c independently of one another are numbers from 0 to 50, preferably from 0 to 30.

In the above formula q, a, x, m, y, z, b and c are preferably integers in their respective ranges.

Particular preference is given to the following polyoxometalates:

$Q_5CO(III)W_{12}O_{40}$ (Q=K, Na, NMe, NBu, or a mixture of these)

$K_5Mn(III)SiW_{11}O_{39}$ $(Me_3NH)_4(NbO_2)PW_{11}O_{39}$ $Na_6Co(III)AlW_{11}O_{40}H_2$ $K_{10}[\beta\text{-}Cu_3SiW_9O_{40}H_3]$ $K_9[P_2V_3W_{17}O_{62}H_2]$ $Na_{12}[WMn_2(H_2O)_2(ZnW_9O_{34})_2]$ $Na_{16}[Cu_4(H_2O)_2(P_2W_{15}O_{56})_2]$ $Na_{10}[Mn_4(H_2O)_2(PW_9O_{34})_2]$ $(NH_4)_{14}[NaP_5W_{30}O_{110}]$*

*=containing water of crystallization

Table I lists a variety of polyoxometalates which were synthesized; most of these catalysts provided positive bleaching results with uptake of air as the oxygen source.

TABLE I

Experimental Data Summary

| POM Class | POM Sub-Class | POM Formula | Hetero* | Homo** |
|---|---|---|---|---|
| Keggin | Keggin | $H_3PW_{12}O_{40}$ | X | X |
| | | $H_4SiW_{12}O_{40}$ | X | X |
| | | $K_6Co(II)W_{12}O_{40}$ | X | |
| | | $K_5Co(III)W_{12}O_{40}$ | X | |
| | Lacunary | $K_7PW_{11}O_{40}$ | X | X |
| | | $K_8SiW_{11}O_{39}$ | X | X |
| | | $K_8SiW_{10}O_{36}$ | X | X |
| | | $\beta\text{-}Na_{10}SiW_9O_{34}$ | X | X |
| | Mono-TMSP | $K_6Mn(II)SiW_{11}O_{39}$ | X | X |
| | | $K_5Mn(III)SiW_{11}O_{39}$ | X | X |
| | | $K_6Co(II)SiW_{11}O_{39}$ | X | X |
| | | $K_5Co(III)SiW_{11}O_{39}$ | X | X |
| | | $K_5Fe(III)SiW_{11}O_{39}$ | X | X |
| | | $K_6Cu(II)SiW_{11}O_{39}$ | X | X |
| | | $K_5Mn(II)PW_{11}O_{39}$ | X | X |
| | | $K_4Mn(III)PW_{11}O_{39}$ | X | X |
| | | $K_5Co(II)PW_{11}O_{39}$ | X | X |
| | | $K_4Co(III)PW_{11}O_{39}$ | X | X |
| | | $K_4Fe(III)PW_{11}O_{39}$ | X | X |
| | | $K_6Cu(II)PW_{11}O_{39}$ | X | X |
| | | $K_5(NbO_2)SiW_{11}O_{39}$ | X | |
| | | $Cs_5(NbO_2)SiW_{11}O_{39}$ | X | |
| | | $Cs_5NbSiW_{11}O_{40}$ | X | |
| | | $(Me_3NH_4(NbO_2)PW_{11}O_{39}$ | X | |
| | | $K_5VSiW_{11}O_{40}$ | X | X |
| | | $K_7Mn(II)AlW_{11}O_{40}H_2$ | X | X |
| | | $Na_6Mn(III)AlW_{11}O_{40}H_2$ | X | X |
| | | $Na_6Co(III)AlW_{11}O_{40}H_2$ | X | X |
| | | $K_6CoAlW_{11}O_{40}$ | | X |
| | | $K_6VAlW_{11}O_{40}$ | | X |
| | | $Na_6VAlW_{11}O_{40}$ | X | X |
| | | $K_6MnBW_{11}O_{40}H_2$ | X | |
| | | $K_7VZnW_{11}O_{40}$ | | X |
| | | $K_8V(IV)Co(II)W_{11}O_{40}$ | X | |

TABLE I-continued

Experimental Data Summary

| POM Class | POM Sub-Class | POM Formula | Hetero* | Homo** |
|---|---|---|---|---|
| | Di-TMSP | $K_6V_2SiW_{10}O_{40}$ | X | X |
| | | $K_7VMnSiW_{10}O_{39}$ | X | X |
| | | $K_7VCoSiW_{10}O_{39}$ | X | X |
| | | $K_6VNbSiW_{10}O_{40}$ | X | X |
| | | $H_5PV_2Mo_{10}O_{40}$ | X | |
| | | $TBA_5PV_2Mo_{10}O_{40}$ | X | |
| | | $Cs_5PV_2W_{10}O_{40}$ | X | |
| | | $K_4[SiMn_2W_{10}O_{40}H_6]$ | X | |
| | Tri-TMSP | $K_7V3SiW_9O_{40}$ | X | X |
| | | $H_7V_3SiW_9O_{40}$ | X | X |
| | | $K_7Mo_2VSiW_9O_{50}$ | X | X |
| | | $K_6V_3PW_9O_{39}$ | X | |
| | | $Cs_7(NbO_2)_3SiW_9O_{37}$ | X | |
| | | $Cs_6(NbO_2)_3PW_9O_{37}$ | X | |
| | | $K_{10}[\beta\text{-}Cu_3SiW_9O_{40}H_3]$ | X | |
| | | $K_5H_5[\alpha\text{-}Cu_3SiW_9O_{40}H_3]$ | X | |
| Dawson | Dawson | $K_6[\alpha\text{-}P_2W_{18}O_{62}]$ | X | X |
| | | $K_6[\beta\text{-}P_2W_{18}O_{62}]$ | X | |
| | Lacunary | $K_9[\alpha_2\text{-}P_2W_{17}O_{61}]$ | X | |
| | | $K_9[\alpha_1\text{-}LiP_2W_{17}O_{61}]$ | X | |
| | | $Na_{12}[\alpha\text{-}P_2W_{15}O_{56}]$ | X | |
| | Mono-TMSP | $K_8[P_2CuW_{17}O_{62}H_2]$ | X | X |
| | | $K_8[P_2Mn(II)W_{17}O_{62}H_2]$ | X | |
| | Tri-TMSP | $K_9[P_2V_3W_{17}O_{62}H_2]$ | X | X |
| Sandwich | Keggin | $Na_{10}[Mn_4(H_2O)_2(PW_9O_{34})_2]$ | | |
| | | $Na_{10}[Co_4(H_2O)_2(PW_9O_{34})_2]$ | | |
| | | $Na_{10}[Cu_4(H_2O)_2(PW_9O_{34})_2]$ | | |
| | | $Na_{12}[WMn_2(H_2O)_2(ZnW_9O_{34})_2]$ | | |
| | | $Na_{12}[WCo_2(H_2O)_2(ZnW_9O_{34})_2]$ | | |
| | | $Na_{12}[WCu_2(H_2O)_2(ZnW_9O_{34})_2]$ | | |
| | Dawson | $Na_{16}[Cu_4(H_2O)_2(P_2W_{15}O_{56})_2]$ | X | |
| | | $Na_{12}[Fe_4(H_2O)_2(P_2W_{15}O_{56})_2]$ | | X |
| | Pressyler | $(NH_4)_{14}[NaP_5W_{30}O_{110}].31H_2O$ | X | |

*"Hetero" refers to a heterogeneous protocol; see Example 2.

**"Homo" refers to a homogeneous protocol; using stain mimic dye molecules (such as Red Acid 88) in a homogeneous medium Under certain circumstances, reductants may provide additional improvement in bleaching activity. Typical but not at all limiting examples of useful reductants are sodium ascorbate and hydroxylamine. When present the reductant and polyoxometallate should be in a relative weight ratio from about 10,000:1 to about 1:100, preferably from about 1,000:1 to about 100:1.

Bleach systems of the present invention may be employed for a wide variety of purposes, but are especially useful in the cleaning of laundry. When intended for such purpose, the polyoxometallate will usually also be combined with surface-active materials, detergency builders and other known ingredients of laundry detergent formulations.

The surface-active material may be naturally derived, or synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range up to 50% by weight, preferably being from 0.5 to 40% by weight of the composition, most preferably 4 to 25%.

Synthetic anionic surface-active materials are usually water-soluble alkali metal salts of organic sulphates and sulphonates having alkyl radicals containing from about 8 to about 22 carbon atoms.

Examples of suitable synthetic anionic surface-active materials are sodium and ammonium alkyl sulphates, especially those obtained by sulphating higher ($C_8$–$C_{18}$) alcohols produced for example from tallow or coconut oil; sodium and ammonium alkyl ($C_9$–$C_{10}$) benzene sulphonates, sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; sarcosinate salts; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulfosuccinates; and olefin sulphonates, which term is used to describe the material made by reacting olefins, particularly $C_{10}$–$C_{20}$ alpha-olefins, with $SO_3$ and then neutralizing and hydrolyzing the reaction product; and sulphates or sulphonated alkyl polyglucosides. The preferred anionic surface-active materials are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active materials which may be used, preferably together with the anionic surface-active materials, include in particular the reaction products of alkylene oxides, usually ethylene oxide, with alkyl ($C_6$–$C_{22}$) phenols, generally 5–25 EO, i.e. 5–25 units of ethylene oxide per molecule; the condensation products of aliphatic ($C_8$–$C_{18}$) primary or secondary linear or branched alcohols with ethylene oxide, generally 2–30 EO, and products made by condensation of ethylene oxide with the reaction products of propylene oxide and ethylene diamine. Other so-called nonionic surface-actives include alkyl polyglucosides, long chain tertiary amine oxides, and fatty amido polyols such as methyl glucamides.

Amphoteric or zwitterionic surface-active materials such as alkylamidopropyl betaines can also be used in the compositions of the invention. If any amphoteric or zwitterionic surface-actives are used, it is generally in small amounts in compositions based on the much more commonly used synthetic anionic and nonionic actives.

Soaps may also be incorporated into the compositions of the invention, preferably at a level of less than 30% by weight. They are particularly useful at low levels in binary (soap/anionic) or ternary mixtures together with nonionic or mixed synthetic anionic and nonionic compounds. Soaps which are used are preferably the sodium, or less desirably potassium, salts of saturated or unsaturated $C_{10}$–$C_{24}$ fatty acids or mixtures thereof. The amount of such soaps can be varied between 0.5 and 25% by weight, with lower amounts of 0.5 to 5% being generally sufficient for lather control. Amounts of soap between 2 and 20%, especially between 5 and 15, are used to give a beneficial effect on detergency. This is particularly valuable in compositions used in hard water where the soap acts as a supplementary builder.

In systems where anionic surfactants such as linear alkylbenzene sulphonate are employed, it may be desirable to include a hydrotrope such as sodium benzene sulphonate to avoid micellization of the anionic surfactant and thereby improve the bleach effect.

The detergent compositions of the invention may normally also contain a detergency builder. Builder materials may be selected from (1) calcium sequestrant materials, (2) precipitating materials, (3) calcium ion-exchange materials and (4) mixtures thereof.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethylmalonate, carboxymethyloxysuccinate, tartrate mono- and di-succinate, oxydisuccinate, crystalline or amorphous aluminosilicates and mixtures thereof.

Polycarboxylic homo- and co-polymers may also be included as builders and to function as powder structurants or processing aids. Particularly preferred are polyacrylic acid (available under the trademark Acrysol from the Rohm and Haas Company) and acrylic-maleic acid copolymers (available under the trademark Sokalan from the BASF Corporation) and alkali metal or other salts thereof.

These builder materials may be present at a level of from 1 to 80% by weight, preferably from 10 to 60% by weight.

Upon dispersal in a wash water, the initial amount of polyoxometalate may range from about 0.001 to about 10 mmol/liter, preferably from about 0.01 to about 5 mmol/liter, most preferably from about 0.1 to about 1 mmol/liter of the aqueous wash liquid. Surfactant when present in the wash water may range from about 0.05 to about 1.0 grams per liter, preferably from about 0.15 to about 0.20 grams per liter. When present, the builder amount may range from about 0.1 to about 3.0 grams per liter.

Apart from the components already mentioned, the bleaching compositions of the invention may contain any of the conventional additives in he amounts in which such materials are normally employed in cleaning compositions. Examples of these additives include dye transfer inhibition agents such as polyamine N-oxide polymers, metallo phthalocyanines, and polymers based on N-vinylpyrrolidone and N-vinylimidazole, lather boosters such as alkanolamides, particularly the monoethanolamides derived from palmkernel fatty acids and coconut fatty acids, lather-depressants such as alkyl phosphates and silicones, anti-redeposition agents such as sodium carboxymethylcellulose and alkyl or substituted alkylcellulose ethers, stabilizers such as ethylene diamine tetraacetic acid and phosphonic acid derivatives (Dequest®), fabric softening agents, inorganic salts such as sodium sulphate, and, usually present in very small amounts, fluorescent agents, perfumes, enzymes such as proteases, cellulases, lipases and amylases, germicides and colorants.

The bleaching system of the present invention may be delivered in a variety of product forms including powders, on sheets or other substrates, in pouches, in tablets, in aqueous liquids, or in nonaqueous liquids such as liquid nonionic detergents.

Except in the operating and comparative examples, or where otherwise explicitly indicated, all numbers in this specification indicating amounts of material ought to be understood as modified by the word "about".

The following examples will more fully illustrate the embodiments of this invention. All parts, percentages and proportions referred to herein and in the appended claims are by weight unless otherwise illustrated.

EXAMPLE 1

Several synthesis of polyoxometalates are reported below. These are only for illustrative purposes of the general synthesis. Many polyoxometalates are also commercially available.

General

Phosphotungstic acid and tungstosilicic acid were purchased from Aldrich and Fluka. They were used without further purification. All other chemicals were obtained from the Fisher Scientific Company. The pH of the reaction was maintained using a Metrohm Titrator with a desired base. All $^{31}P$ and $^{29}Si$ NMR were acquired on a Bruker AC-500 MHz spectrometer.

Preparation of Potassium α-undecatungstosilicate, $K_8[\alpha\text{-}SiW_{11}O_{39}]$[8]

Into a 1 L Erlenmeyer flask equipped with a stir bar, tungstosillicic acid (216.3 g, 0.08 mole) was dissolved in 200 mL of water at 40° C. Solid sodium bicarbonate (54 g, 0.64 mole) was added slowly to raise the pH to 7.9. Sometimes, additional amounts of sodium bicarbonate was necessary to adjust the solution pH to 7.9. The solution was allowed to stir for 5 minutes. Excess KCl (134.4 g, 1.80 mole) was added to induce precipitation of the product as potassium salts. The white solid was collected by vacuum filtration and dried in a vacuum oven. The complex was characterized in $D_2O$ by $^{29}Si$ NMR with peak at 84.725.

Preparation of Potassium γ-decatungstosilicate, $K_8[\gamma\text{-}SiW_{10}O_{36}]$[7]

Into a 125 mL Erlenmeyer flask equipped with a stir bar, $K_8[\alpha\text{-}SiW_{11}O_{39}]$ (5.0 g, 1.7 mole) was taken in 100 mL of water. The pH of this solution was adjusted to 9.1 by addition of 2M potassium carbonate using the Metrohm titrator. The solution was stirred for an additional 15 minutes while maintaining the pH at 9.1 with 2M potassium carbonate. Approximately 2 mL of base was used in the reaction. The potassium salt of the desired product was allowed to precipitate out by adding excess of potassium chloride (13.3 g, 0.18 mole). The white solid was collected by vacuum filtration and dried in a vacuum oven. It is characterized in $D_2O$ by $^{29}$ Si NMR with peak at 84.954.

Preparation of Sodium β-nonatungstosilicate, $Na_{10}[\beta\text{-}SiW_9O_{34}]$[7]

Into a 250 mL beaker containing a stir bar, sodium metasilicate (3.26 g, 0.01 mole) was dissolved in 50 mL of water and sodium tungstate (30.03 g, 0.09 mole) added. The resulting solution had a pH of 12.6. To this solution, 18 mL of 6M HCl was added slowly using the Metrohm titrator over a period of about 30 minutes. The final solution contained some unreacted sodium silicate. It was filtered to give a clear solution which had a pH of about 8.4. The clear solution was allowed to crystallize in a refrigerator. The white crystals were filtered and dried in a vacuum oven. The complex was characterized in $D_2O$ by $^{29}$Si NMR with peak at 83.814.

Preparation of $K_8[P_2CuW_{17}O_{62}H_2]$ $K_{10}[P_2W_{17}O_{61}].20H_2O$ (8.7 g, $1.77\times10^{-3}$ mol) was dissolved in water (26 mL) at 70° C. Anhydrous $CuSO_4$ (0.35 g, $2.19\times10^{-3}$ mol) was then added to the mixture and stirred until dissolved. The mixture was then allowed to cool gradually to ambient temperature (25° C.). A green precipitate subsequently developed which was filtered and dried giving 6.9 g of a green crystalline solid. Recrystallization from water yielded 6.4 g of a green crystalline solid.

EXAMPLE 2

The polyoxometalates identified above were evaluated for their effectiveness in a Heterogeneous Protocol consisting of two stain monitors, strawberry (CS-18) and Tea (BC-1). Evaluations were performed at pH 6, 8 and 10 at 25° C., under a constant flow of oxygen with and without reducing agents (hydroxylamine and sodium ascorbate). Catalyst concentration was kept at $1\times10^{-5}$ M.

An Outline of the Essential Protocol Steps a) Measure the initial reflectance of the swatches ($R_i$).

b) Saturate the wash solution with air.

c) Wash, rinse and dry the swatches.

d) Measure the final reflectance of the swatches ($R_f$).

All work was conducted in a Tergotometer with 2L stainless steel pots. The swatches were dried flat on a rack in a Kenmore dryer.

Each Tergotometer Pot was filled with 1 liter of milli-Q-water containing the carbonate buffer solution which was saturated for 15 minutes with air under agitation at 25° C. Tea stained (BC-1) swatches were washed for 30 minutes in the presence of Polyoxometalates and air. All swatches were rinsed twice for 3 minutes with agitation at 25° C. and dried flat on a rack in a Kenmore with soft heat for 30 minutes.

Bleaching Evaluation

To quantify the degree of stain removal, the reflectance of 4 stained swatches (4 per pot) were measured before and after washing using a Gardner reflectometer (Model #2000) set at 460*nm (*UV filter). The change in reflectance (ΔR) was determined by taking the difference of the swatch before and after each washing. The standard deviation (σ) and $\Delta\Delta R_{ave}$ was assigned to each experimental group.

$$\Delta R = R_f - R_i$$

$R_i$=Initial reflectance of stained swatch before washing.

$R_f$=Final reflectance of stained swatch after washing.

$$\Delta R_{polyoxometallate\ system+control} - \Delta R_{control} = \Delta\Delta R \text{ - - - } 1\text{–}3x \text{ - - -}$$
$$\Delta\Delta R_{ave}$$

$\Delta\Delta R_{ave}$=Represents the average bleaching by the polyoxometallate system.

N=number of measurements

TABLE 1

Summary of the Heterogeneous Protocol Screening Results of Selected POMs at pH = 6

| Serial No. | Catalyst (1.0 × $10^{-5}$ M) | Δ(ΔR)(Screening Conditions: air, 25° C., pH = 6, 1 Hour) Catalyst Alone BC-1 | Catalyst Alone CS-18 | Catalyst + Sodium Ascorbate[a] BC-1 | Catalyst + Sodium Ascorbate[a] CS-18 | Catalyst + Hydroxylamine[b] BC-1 | Catalyst + Hydroxylamine[b] CS-18 |
|---|---|---|---|---|---|---|---|
| 1 | $Na_2WO_4$ | 0.1 | −0.1 | −0.1 | −0.5 | −0.1 | 0.2 |
| 2 | $H_4SiW_{12}O_{40}$ | 0.4 | 0.1 | 0.3 | 0.1 | 0.2 | 0.5 |
| 3 | $H_3PW_{12}O_{40}$ | 0.2 | 0.1 | 0.1 | 0.5 | 0.1 | 0.1 |
| 4 | α-$K_8SiW_{11}O_{39}$ | 0.1 | 1.0 | 0.0 | 0.5 | 0.1 | 0.9 |
| 5 | γ-$K_8SiW_{10}O_{39}$ | 0.7 | 1.0 | 0.1 | 1.4 | 0.6 | 1.1 |
| 6 | β-$Na_{10}SiW_9O_{34}$ | 0.4 | 0.4 | 0.2 | 0.4 | 0.2 | 0.5 |
| 7 | α-$K_7PW_{11}O_{39}$ | 0.2 | 0.0 | 0.0 | 0.4 | 0.1 | 0.0 |
| 8 | $K_7SiVMnW_{10}O_{39}$ | 0.7 | 0.5 | −0.2 | 0.3 | 0.7 | 0.9 |
| 9 | $K_8[P_2CuW_{17}O_{62}H_2]$ | 0.1 | −0.2 | 1.8 | 2.6 | — | — |
| 10[c] | $K_8[P_2CuW_{17}O_{62}H_2]$ | — | — | 0.1 | 0.1 | — | — |
| 11 | $K_{10}[\alpha\text{-}2\text{-}P_2W_{17}O_{61}]$ | 0.2 | 0.7 | −0.1 | 0.6 | — | — |

[a]Used at 1.0 × $10^{-3}$M

[b]Used at 4.0 × $10^{-3}$M

[c]Air absent, argon atmosphere

TABLE 2

Summary of the Heterogeneous Protocol Screening Results of Selected POMS at pH = 8

| Serial No. | Catalyst ($1.0 \times 10^{-5}$M) | Δ(ΔR) (Screening Conditions: air, 25° C., pH = 8, 1 Hour) Catalyst Alone BC-1 | Catalyst Alone CS-18 | Catalyst + Sodium Ascorbate[a] BC-1 | Catalyst + Sodium Ascorbate[a] CS-1B | Catalyst + Hydroxylamine[b] BC-1 | Catalyst + Hydroxylamine[b] CS-18 |
|---|---|---|---|---|---|---|---|
| 1 | $Na_2WO_4$ | 0.1 | −0.2 | −0.2 | −0.3 | 0.3 | 0.4 |
| 2 | $H_4SiW_{12}O_{40}$ | 0.0 | 0.1 | 0.3 | 0.1 | −0.1 | −0.1 |
| 3 | $H_3PW_{12}O_{40}$ | −0.1 | −0.1 | 0.0 | 0.0 | 0.0 | 0.1 |
| 4 | $\alpha$-$K_8SiW_{11}O_{39}$ | −0.3 | −0.1 | 0.0 | 0.3 | 0.1 | 0.3 |
| 5 | $\gamma$-$K_8SiW_{10}O_{39}$ | 0.1 | 0.1 | 0.0 | 0.3 | 0.4 | 0.3 |
| 6 | $\beta$-$Na_{10}SiW_9O_{34}$ | 0.0 | 0.0 | 0.0 | 0.2 | 0.0 | 0.2 |
| 7 | $\alpha$-$K_7PW_{11}O_{39}$ | 0.0 | −0.5 | −0.2 | 0.1 | −0.1 | −0.2 |
| 8 | $K_7SiVMnW_{10}O_{39}$ | 0.2 | 0.4 | −0.1 | −0.2 | 0.2 | −0.1 |
| 9 | $K_8[P_2CuW_{17}O_{62}H_2]$ | −1.1 | −0.9 | 1.3 | 2.0 | — | — |
| 10[c] | $K_8[P_2CuW_{17}O_{62}H_2]$ | — | — | −0.2 | −0.8 | — | — |
| 11 | $K_{10}[\alpha\text{-}2\text{-}P_2W_{17}O_{61}]$ | 0.01 | 0.3 | 0.3 | 0.03 | — | — |
| 12 | $Cs_5NbSiW_{11}O_{40}$ | 0.5 | — | 0.4 | — | 0.4 | — |
| 13 | $K_5(NbO_2)SiW_{11}O_{39}$ | 0.04 | — | −0.2 | — | 0.4 | — |
| 14 | $(Me_3NH)_4(NbO_2)PW_{11}O_{39}$ | 0.4 | — | 0.9 | — | 0.3 | — |
| 15 | $K_7Mo_2VSiW_9O_{40}$ | 0.7 | — | 0.01 | — | 0.2 | — |
| 16 | $K_7VMnSiW_{10}O_{39}$ | 0.4 | — | −0.1 | — | 0.2 | — |
| 17 | $K_7VCoSiW_{10}O_{39}$ | 0.1 | — | 0.1 | — | 0.1 | — |

[a]Used at $1.0 \times 10^{-3}$M
[b]Used at $4.0 \times 10^{-3}$M
[c]Air absent, argon atmosphere

TABLE 3

Summary of the Heterogeneous Protocol Screening Results of Selected POMs at pH = 10

| Serial No. | Catalyst ($1.0 \times 10^{-5}$M) | Δ(ΔR) (Screening Conditions: air, 25° C., pH = 10, 1 Hour) Catalyst Alone BC-1 | Catalyst Alone CS-18 | Catalyst + Sodium Ascorbate[a] BC-1 | Catalyst + Sodium Ascorbate[a] CS-18 | Catalyst + Hydroxylamine[b] BC-1 | Catalyst + Hydroxylamine[b] CS-18 |
|---|---|---|---|---|---|---|---|
| 1 | $Na_2WO_4$ | 0.2 | 0.1 | −0.3 | −0.4 | 0.2 | 0.2 |
| 2 | $H_4SiW_{12}O_{40}$ | −0.2 | 0.2 | −0.3 | 0.1 | −0.3 | −0.9 |
| 3 | $H_3PW_{12}O_{40}$ | 0.2 | −0.1 | −0.1 | −0.4 | 0.1 | 0.1 |
| 4 | $\alpha$-$K_8SiW_{11}O_{39}$ | 0.2 | −0.1 | 0.3 | −0.4 | 0.0 | −0.2 |
| 5 | $\gamma$-$K_8SiW_{10}O_{39}$ | −0.1 | 0.1 | 0.1 | −0.4 | 0.1 | 0.1 |
| 6 | $\beta$-$Na_{10}SiW_9O_{34}$ | −0.3 | 0.0 | −0.1 | 0.1 | −0.1 | −0.2 |
| 7 | $\alpha$-$K_7PW_{11}O_{39}$ | 0.1 | −0.1 | −0.2 | −0.2 | 0.1 | 0.0 |
| 8 | $K_7SiVMnW_{10}O_{39}$ | 0.2 | 0.1 | 0.1 | 0.1 | 1.2 | 2.5 |
| 9 | $K_8[P_2CuW_{17}O_{62}H_2]$ | −0.8 | −1.1 | −0.3 | 1.4 | — | — |
| 10[c] | $K_8[P_2CuW_{17}O_{62}H_2]$ | — | — | −0.1 | −0.5 | — | — |
| 11 | $K_{10}[\alpha\text{-}2\text{-}P_2W_{17}O_{61}]$ | 0.1 | −0.1 | 0.2 | 0.4 | — | — |

[a]Used at $1.0 \times 10^{-3}$M
[b]Used at $4.0 \times 10^{-3}$M
[c]Air absent, argon atmosphere The foregoing description and examples illustrate selected embodiments of the present invention. In light thereof variations and modifications will be suggested to one skilled in the art, all of which are within the spirit and purview of this invention.

What is claimed is:

1. A method for bleaching laundry or household surfaces comprising:

(i) providing a wash medium with a bleaching composition comprising polyoxometalates;

(ii) contacting a stained substrate with the wash medium of step (i) for a time and in an amount sufficient to remove the stains; and wherein air is employed as a primary source of oxygen atoms for bleaching.

2. The method according to claim 1 wherein bleaching is performed at a pH between 6 and 10.

3. The method according to claim 2 wherein the pH ranges from about 8 to about 9.

4. A method according to claim 1 wherein the medium further includes a surfactant.

5. The method according to claim 1 wherein the polyoxometalates are present in the wash medium in an amount from about 0.001 to about 10 mmol/liter.

* * * * *